US010202817B2

(12) United States Patent
Arteaga et al.

(10) Patent No.: US 10,202,817 B2
(45) Date of Patent: Feb. 12, 2019

(54) PACKER ASSEMBLY WITH INSERTS FOR BLOWOUT PREVENTER

(71) Applicant: Cameron International Corporation, Houston, TX (US)

(72) Inventors: Nicolas J. Arteaga, Jersey Village, TX (US); Taylor R. Mozisek, Katy, TX (US); Oscar Jones, Houston, TX (US); David Rossi, Katy, TX (US)

(73) Assignee: Cameron International Corporation, Houston, TX (US)

( * ) Notice: Subject to any disclaimer, the term of this patent is extended or adjusted under 35 U.S.C. 154(b) by 98 days.

(21) Appl. No.: 15/234,683

(22) Filed: Aug. 11, 2016

(65) Prior Publication Data

US 2018/0045011 A1 Feb. 15, 2018

(51) Int. Cl.
*E21B 33/06* (2006.01)

(52) U.S. Cl.
CPC ..... *E21B 33/062* (2013.01)

(58) Field of Classification Search
CPC ..... E21B 33/06; E21B 33/061; E21B 33/062; E21B 33/063; E21B 33/08; E21B 33/085; E21B 2033/005
USPC ..... 251/1.1, 1.2, 1.3
See application file for complete search history.

(56) References Cited

U.S. PATENT DOCUMENTS 2,194,258 A * 3/1940 Allen ..... E21B 33/062 251/1.3
2,746,710 A * 5/1956 Jones ..... E21B 33/062 251/1.3
2,855,172 A * 10/1958 Jones ..... E21B 33/062 251/1.3
2,947,508 A * 8/1960 Allen ..... E21B 33/062 251/1.3
3,554,278 A * 1/1971 Reistle, III ..... E21B 17/1007 166/85.1
3,955,622 A * 5/1976 Jones ..... E21B 17/1007 166/352
4,099,699 A * 7/1978 Allen ..... E21B 33/06 251/1.2
4,163,477 A * 8/1979 Johnson ..... E21B 29/08 137/263
4,215,747 A * 8/1980 Cox ..... E21B 33/047 166/85.5
4,458,876 A * 7/1984 Schaeper ..... E21B 33/06 251/1.2
5,013,005 A * 5/1991 Nance ..... E21B 33/062 251/1.3

* cited by examiner

*Primary Examiner* — Matthew W Jellett
*Assistant Examiner* — Jonathan Waddy
(74) *Attorney, Agent, or Firm* — Helene Raybaud

(57) ABSTRACT

A blowout preventer ("BOP") includes a housing comprising a vertical bore extending through the housing and a packer assembly movably positioned within the housing and configured to form a seal within the housing. The packer assembly includes an elastomeric body comprising an elastomeric material and inserts positioned within the elastomeric body and in parallel alignment with respect to each other.

15 Claims, 9 Drawing Sheets

PACKER ASSEMBLY WITH INSERTS FOR BLOWOUT PREVENTER

BACKGROUND

This section is intended to provide relevant contextual information to facilitate a better understanding of the various aspects of the described embodiments. Accordingly, it should be understood that these statements are to be read in this light and not as admissions of prior art.

Blowout preventers (BOPS) are used extensively throughout the oil and gas industry. Typical BOPs are used as a large specialized valve or similar mechanical device that seal, control, and monitor oil and gas wells. The two categories of BOPs that are most prevalent are ram BOPs and annular BOPs. Blowout preventer stacks frequently utilize both types of BOPs, typically with at least one annular BOP stacked above several ram BOPs. The ram assemblies (i.e., rams) in ram BOPs allow for shearing drill pipe in the case of shear ram assemblies, sealing off around drill pipe in the case of pipe ram assemblies or variable bore ram assemblies, or sealing off the bore in the case of blind ram assemblies. Typically, a BOP stack may be secured to a wellhead and may provide a safe means for sealing the well in the event of a system failure.

A typical ram BOP includes a main body or housing with a vertical bore. Ram bonnet assemblies may be bolted to opposing sides of the main body using a number of high tensile fasteners, such as bolts or studs. These fasteners are required to hold the bonnet in position to enable the sealing arrangements to work effectively. One or more elastomeric sealing elements or "packers" may be used to form a seal within the main body and against the ram assemblies. There are several configurations, but essentially they are all directed to preventing a leakage bypass between the mating faces of the ram assembly and the main body. Each bonnet assembly includes a piston that is laterally movable within a ram cavity of the bonnet assembly by pressurized hydraulic fluid acting on one side of the piston. The opposite side of each piston has a connecting rod attached thereto that in turn has a ram assembly mounted thereon.

The ram assemblies are designed to move laterally toward the vertical bore of the BOP to shear or seal off on any object located therein. For a shear ram BOP, the shear ram assemblies are used to shear or cut any object located in the vertical bore of the blowout preventer. Pipe ram assemblies and variable bore ram assemblies utilize seals or packers that close in on and seal off on a tubular within the vertical bore of the BOP, such as a section of drill pipe used during drilling operations. Blind ram assemblies also utilize seals, in which the ram assemblies close in and across the bore of the BOP when no object is present to seal across the bore.

Packers used for a ram-type or annular BOPs can be designed to seal around pipe of a specific size in the BOP bore when the BOP is closed. Other packers though may be configured to seal around a range of pipe sizes, and are referred to as variable bore packers. Both packers form a pressure tight seal during a kick until the well bore pressure can be controlled. For the packers to form a seal within the BOP though, the pipe or objects positioned within the BOP housing are required to have a circular cross-section, and must be positioned in axial alignment with the BOP housing and within a specific location relative to the rams.

SUMMARY

In one embodiment, a blowout preventer includes a housing having a vertical bore extending through the housing. A packer assembly is movably positioned within the housing and is configured to form a seal within the housing. The packer assembly includes an elastomeric body having an elastomeric material, and the packer assembly further includes inserts positioned within the elastomeric body and in parallel alignment with respect to each other.

In one embodiment, a packer assembly to form a seal within a blowout preventer includes an elastomeric body having an elastomeric material. The packer assembly also includes inserts positioned within the elastomeric body and in parallel alignment with respect to each other.

In one embodiment, a method of sealing about multiple objects within a vertical bore of a blowout preventer housing includes moving a pair of opposing ram assemblies at least partially into the vertical bore of the blowout preventer housing, each ram assembly comprising a packer assembly with inserts. The method further includes engaging the multiple objects with each of the packer assemblies within the vertical bore of the blowout preventer housing, moving inserts of the packer assemblies in parallel with respect to each other, and sealing about the multiple objects with the packer assemblies within the vertical bore of the blowout preventer housing.

DESCRIPTION OF THE DRAWINGS

For a detailed description of the embodiments of the invention, reference will now be made to the accompanying drawings in which.

DETAILED DESCRIPTION

Figure 1:
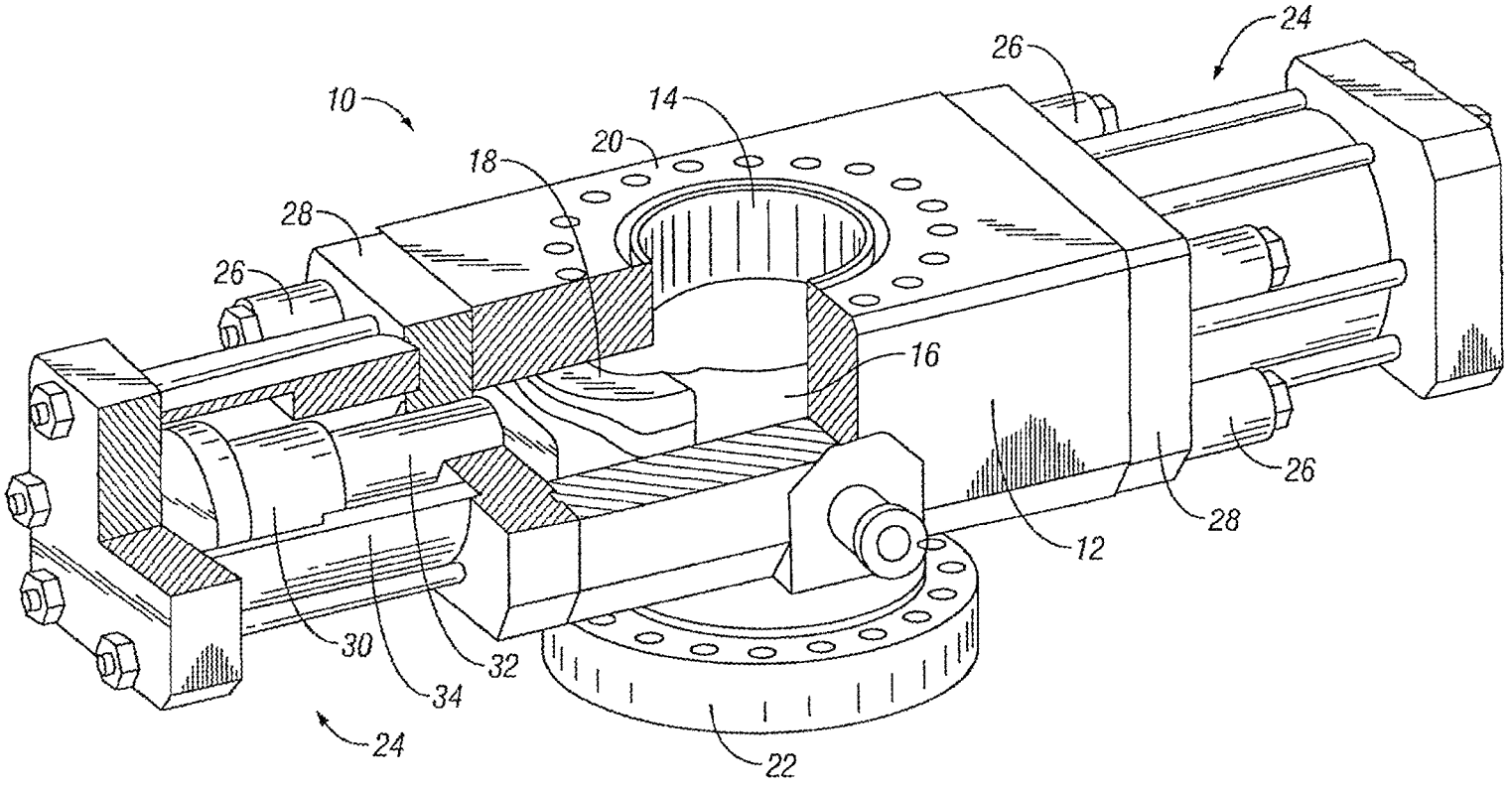
FIG. 1 depicts a sectional view of a ram blowout preventer, according to one or more embodiments.

The present disclosure may be used within a BOP, such as ram BOP. In reference to FIG. 1, a sectional view of a ram BOP 10 in accordance with one or more embodiments of the present disclosure is shown. The BOP 10 includes a housing 12, such as a hollow body, with a (e.g., vertical) bore 14 that enables passage of fluid or an object (e.g., tubular member) through the BOP 10. The housing 12 further includes one or more cavities 16, such as cavities 16 opposed from each other with respect to the bore 14, with a ram assembly 18 movably positioned within each cavity 16. The BOP 10 may be coupled to other equipment that facilitates natural resource production. For instance, production equipment or other components may be attached to the top of the BOP 10 using a connection 20 (which may be facilitated in the form of fasteners), and the BOP 10 may be attached to a wellhead, spool, or other component using the flange 22 and additional fasteners.

Two or more bonnet assemblies 24 are secured to the housing 12 and include various components that facilitate control of the ram assemblies 18 positioned in the BOP 10. The bonnet assemblies 24 are coupled to the housing 12 by using one or more fasteners 26 to secure the bonnets 28 of the bonnet assemblies 24 to the housing 12. The ram assemblies 18 are actuated and moved through the cavities 16, into and out of the bore 14, by actuators, such as by operating and moving a piston 30 and a rod 32 coupled thereto within a housing or cylinder 34 of the bonnet assemblies 24. In operation, a force (e.g., from hydraulic pressure) may be applied to the pistons 30 to drive the rods 32, which in turn drives the ram assemblies 18 coupled thereto into the bore 14 of the BOP 10. The ram assemblies 18 cooperate with one another when driven together to seal the bore 14 and inhibit flow through the BOP 10. For example, the ram assemblies 18 may seal about a pipe or a tubular member present within the bore 14 of the BOP housing 12, or the ram assemblies 18 may seal across the bore 14 of the BOP housing 12 if no object is present within the bore 14.

Accordingly, disclosed herein are a BOP apparatus, ram assembly, and/or a packer assembly for a BOP apparatus. As shown above, the BOP may be a ram BOP. The packer assembly is used within the BOP to form a seal within the BOP, and may have the combined capabilities of one or more different ram assemblies, such as the capabilities of a pipe ram packer assembly, a blind ram packer assembly, and/or a variable bore ram packer assembly. For example, the packer assembly may be used to form a seal about one or more objects positioned within the BOP, or may be used to form a seal about itself and across the bore of the BOP housing when no object is positioned within the BOP. The packer assembly includes an elastomeric body with multiple inserts positioned within the elastomeric body to provide support to the elastomeric body when forming the seal. The inserts may be positioned within the elastomeric body, such as in parallel alignment with respect to each other, to facilitate sealing within the BOP.

Figure 2:
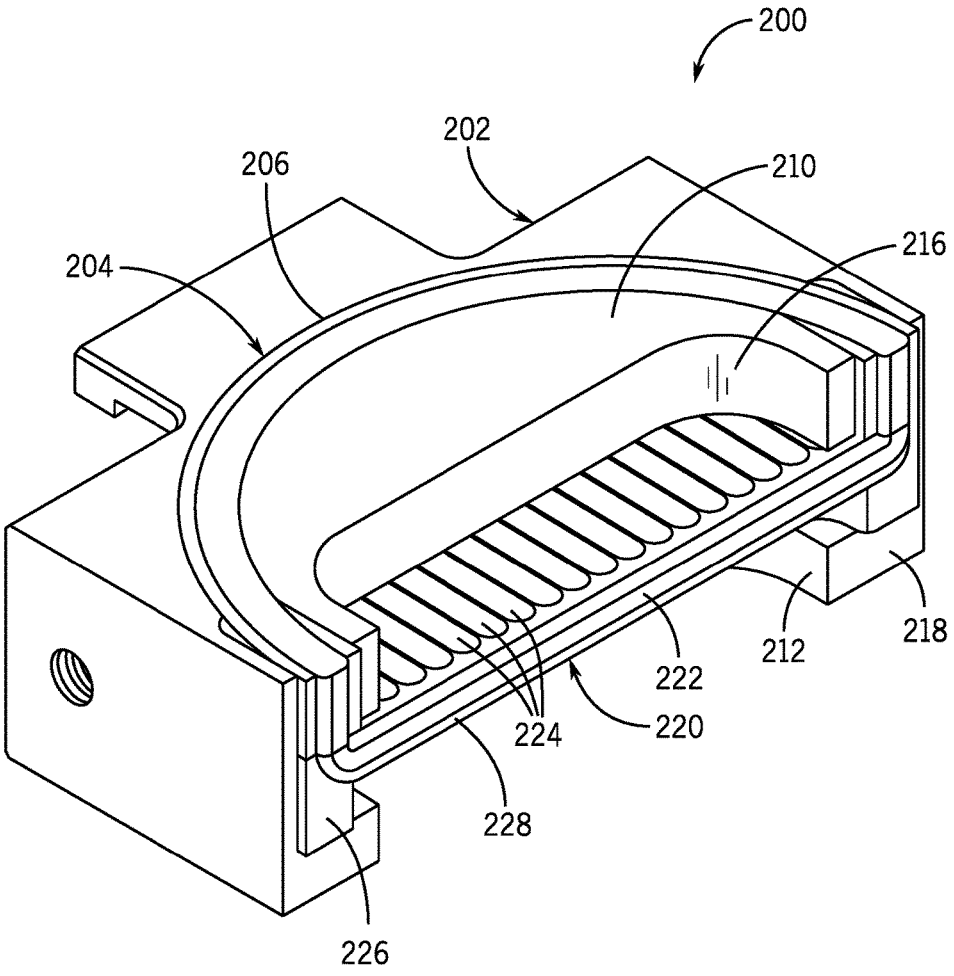
FIG. 2 depicts an above perspective view of a ram assembly, according to one or more embodiments.
Figure 3:
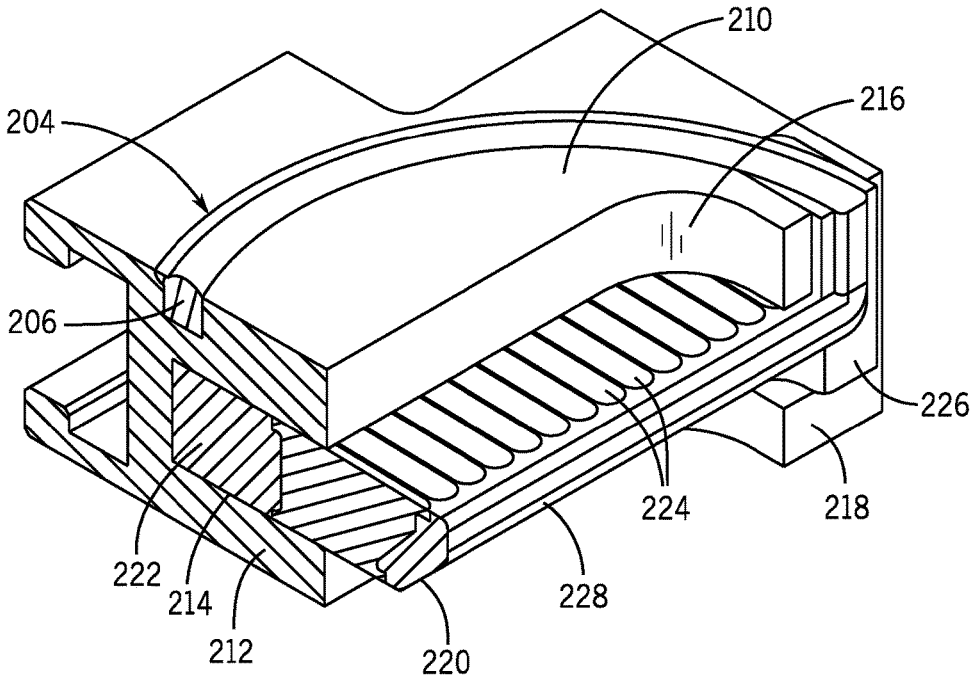
FIG. 3 depicts a sectional perspective view of a ram assembly, according to one or more embodiments.
Figure 4:
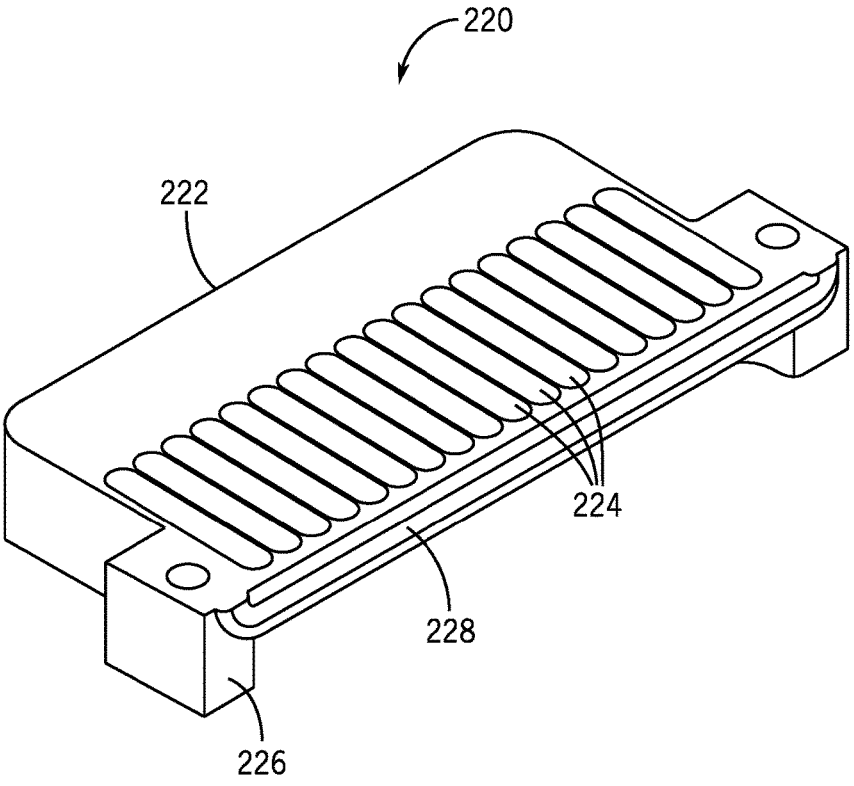
FIG. 4 depicts an above perspective view of a packer assembly, according to one or more embodiments.
Figure 5:
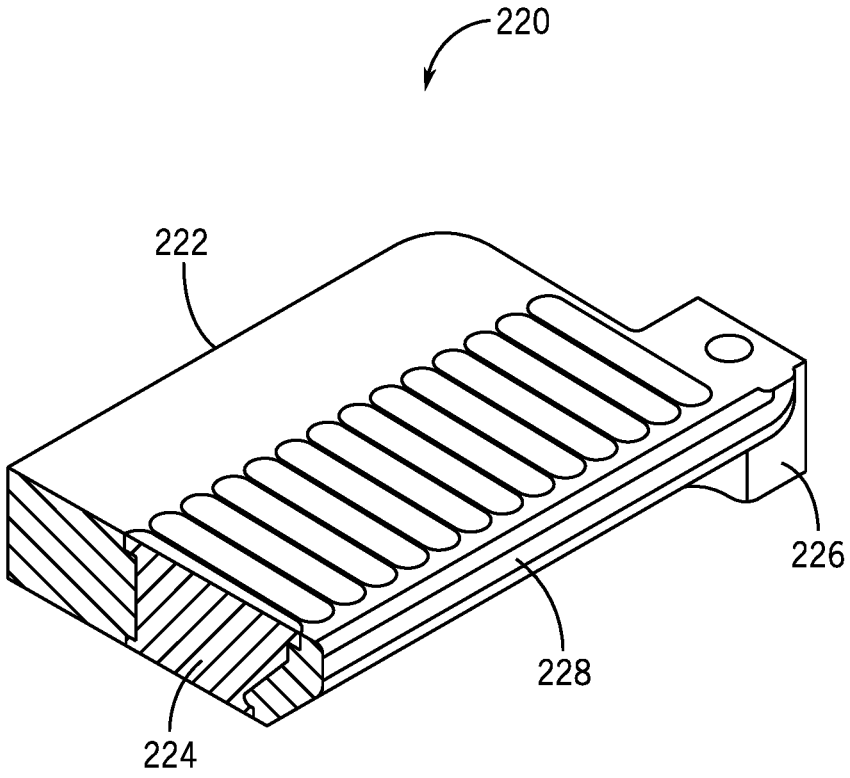
FIG. 5 depicts a sectional perspective view of a packer assembly, according to one or more embodiments.

Referring now to FIGS. 2-5, multiple views of a ram assembly 200, which includes a packer assembly 220, in accordance with one or more embodiments of the present disclosure are shown. FIG. 2 shows an above perspective view of the ram assembly 200, FIG. 3 shows a sectional perspective view of the ram assembly 200, FIG. 4 shows an above perspective view of the packer assembly 220, and FIG. 5 shows a sectional perspective view of the packer assembly 220.

The ram assembly 200 includes a ram body 202, a top seal 204, and the packer assembly 220. The ram body 202 is a generally rectangular in this embodiment, but may have any type of shape to fit in the cavities 16 of the BOP housing 12. The ram body 202 includes an upper body 210 and a lower body 212 to define a ram packer cavity 214 therebetween. A ram bore profile 216 is also formed within a front face 218 of the ram body 202. The ram bore profile 216 may be substantially rectangular and may have rounded corners. The ram bore profile 216 extends vertically through the upper body 210 and the lower body 212 to the ram packer cavity 214. The top seal 204 includes an elastomeric element that seals between the ram body 202 and the cavity 16 of the BOP housing 12. As shown, the top seal 204 is positioned within a top seal cavity 206 formed within the ram body 202, and more particularly formed within the upper body 210 of the ram body 202. The top seal 204 and the packer assembly 220 may also couple, engage, or connect with each other, such as by having a pin from the top seal 204 fit into a slot or hole formed within the packer assembly 220.

The packer assembly 220 includes the elastomeric body 222 formed from or including an elastomeric material (e.g., natural or synthetic rubber). The packer assembly 220 includes multiple inserts 224 positioned within and molded into elastomeric body 222. The inserts 224 provide support to the elastomeric body 222 during sealing engagement (e.g., against an object, tubular member, or against another packer assembly). The elastomeric body 222 may include a rectangular shape with one or more rounded corners. The elastomeric body 222 may also include a front face 226 with a lip 228 protruding from the front face 226. The lip 228 may be a portion of the elastomeric body 222 that directly engages and contacts an object or another packer assembly for sealing engagement.

The inserts 224 are positioned within the packer assembly 220 such that one or more of the inserts 224 are in parallel alignment with respect to each other. The inserts 224 may generally have a rectangular cross-section with one or more rounded corners, with the longer sides of the inserts 224 extending in a parallel direction with respect to each other.

As the inserts 224 are not affixed to each other, the inserts 224 are movable with respect to each other in a direction that is parallel with respect to each other. The inserts 224 are movable in the same direction, and may be moveable only in the same direction, as that of the movement of the ram assembly 200 when moving into and out of the bore 14 of the BOP housing 12.

Figure 6B:
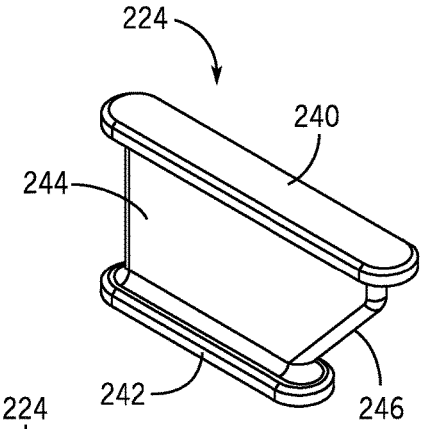
FIGS. 6A-6D depict multiple views of an insert, according to one or more embodiments.
Figure 6A:
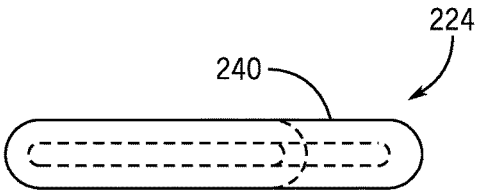
Figure 6C:
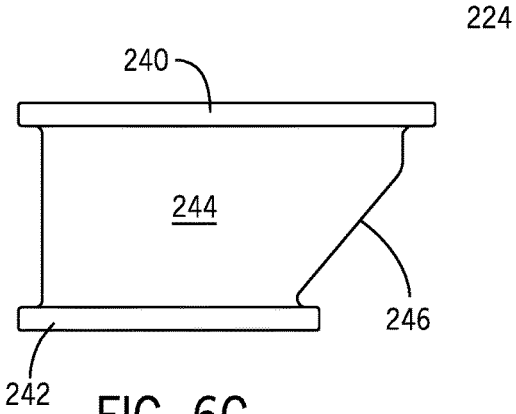
Figure 6D:
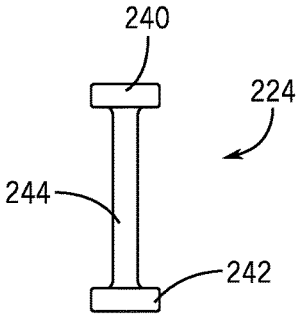
Figure 8:
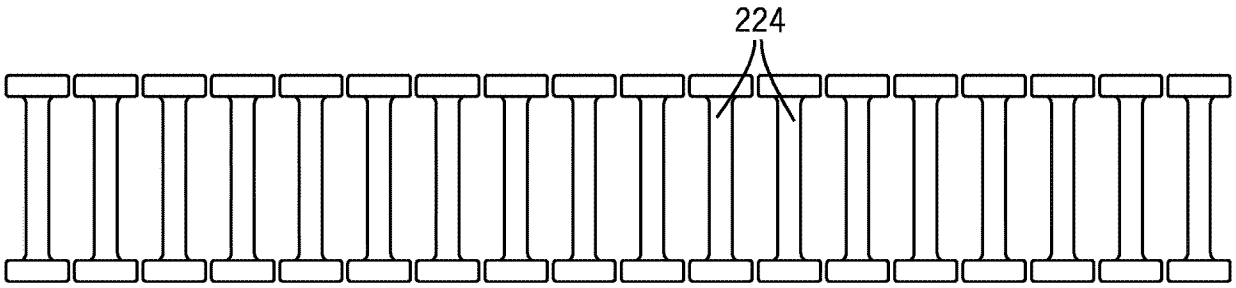
FIG. 8 depicts a front view of the arrangement of inserts of a packer assembly with the elastomeric body removed, according to one or more embodiments.

Referring now to FIGS. 6A-6D and 8, multiple views of an insert 224 in accordance with the present disclosure are shown. FIG. 6A shows a top down view of the insert 224, FIG. 6B shows a perspective view of the insert 224, FIG. 6C shows a side view of the insert 224, FIG. 6D shows a back view of the insert 224, and FIG. 8 shows a front view of the arrangement of the inserts 224 within a packer assembly with the elastomeric body removed. The inserts 224 may each include a top support 240 (e.g., top plate), a bottom support 242 (e.g., bottom plate), and a central support 244 (e.g., central web). The top support 240 and the bottom support 242 may be substantially rectangular shaped with one or more rounded corners, with the central support 244 positioned between the top support 240 and the bottom support 242. The central support 244 extends between the top support 240 and the bottom support 242 to connect the top support 240 and the bottom support 242. The central support 244 may be integrally formed with the top support 240 and the bottom support 242, such as by casting, or the central support 244 may be formed separate from the top support 240 and the bottom support 242 and then later coupled or attached, such as by welding. The top support 240 may also be larger or longer than the bottom support 242. The central support 244 may have a tapered front edge 246. The elastomeric body 222 may have a similar shaped and tapered front edge such that the insert 224 and the elastomeric body 222 have a similar contour.

Figure 7:
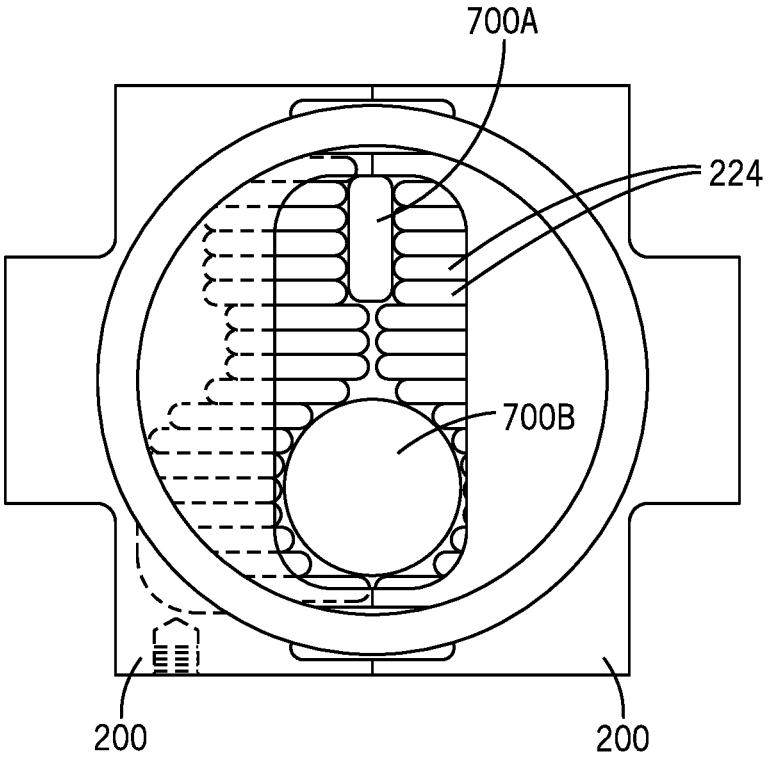
FIG. 7 depicts a top down view of a BOP including ram assemblies as arranged in the BOP in the closed position, according to one or more embodiments.

Referring now to FIG. 7, a top down view of ram assemblies 200 as arranged in a BOP in a closed position in accordance with one or more embodiments of the present disclosure is shown. When positioned within the BOP 10, such as shown in FIG. 7, the ram assembly 200 may be movable within the cavity 16 and into and out of the bore 14 to seal about a tubular member or object present within the bore 14 of the BOP housing 12, or seal across the bore 14 of the BOP housing 12 and against another corresponding ram assembly 200 if no object is present within the bore 14. For example, FIG. 7 shows ram assemblies 200 in the closed position to form a seal against multiple objects 700A and 700B positioned within the bore of a BOP. The objects may not be circular in cross-section, and may be offset or positioned off-center from an axis of the vertical bore of the BOP. For example, the object 700A may be a cable line package or conduit having a rectangular cross-section, or the object 700B may be a tubular member having a circular cross-section. The objects 700A and 700B may also each be offset and positioned off-center from an axis of the vertical bore of the BOP.

The inserts 224 of the packer assembly 220 may move in parallel with respect to each other to accommodate the size and shape of the objects 700A and 700B. For example, as the ram assemblies 200 move towards each other within a blowout preventer, the packer assembly 220 associated with each ram assembly 200 may contact the objects 700A and 700B first at the location where the object is largest or widest. The ram assemblies 200 may continue to move towards each other, but the inserts 224 may stop moving with respect to the object at the locations where the packer assembly 220 then contacts the object to accommodate the size and shape of the object. In locations or areas where no object is then present, the packer assemblies 220 of the opposing ram assemblies 200 may engage and contact each other. This may enable the packer assembly 220 to substantially surround and form seals about the objects 700A and 700B. Further, the packer assemblies 220 may seal against each other in the event that no objects are present.

Figure 9:
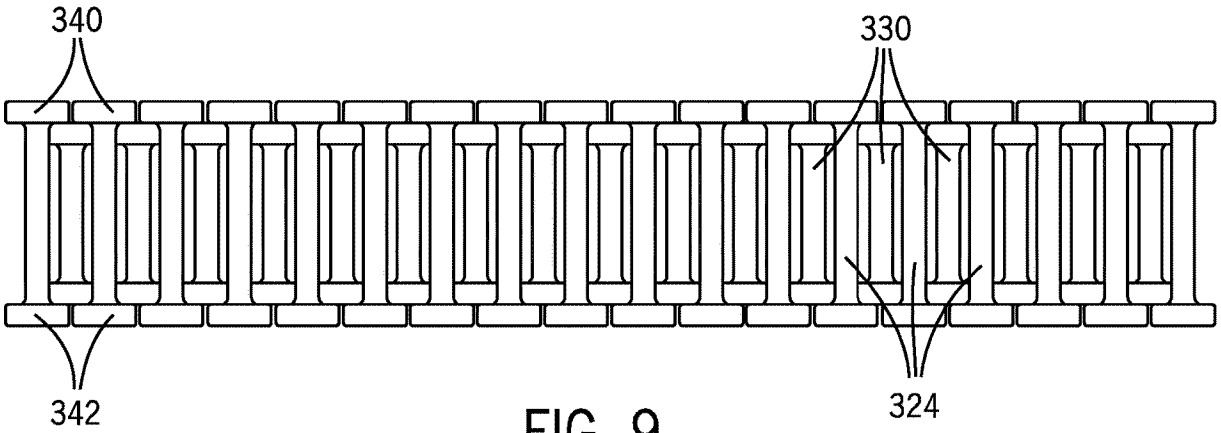
FIG. 9 depicts a front view of the arrangement of inserts and interior inserts of a packer assembly with the elastomeric body removed, according to one or more embodiments.
Figure 10:
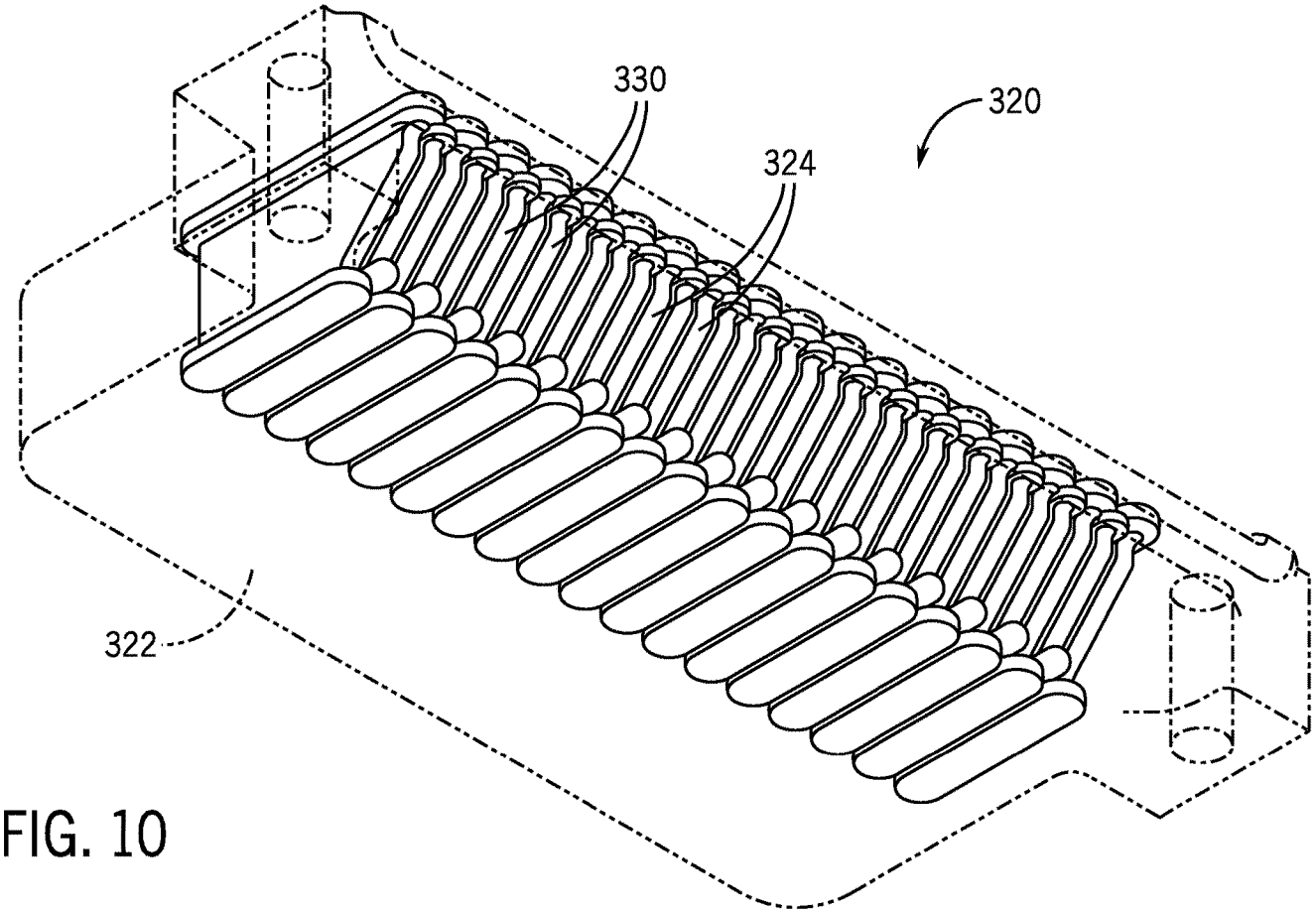
FIG. 10 depicts a bottom perspective transparent view of the arrangement of inserts and interior inserts of a packer assembly including the elastomeric body, according to one or more embodiments.

Referring to FIGS. 9 and 10, in one or more other embodiments, a packer assembly 320 in may also include inserts of different sizes. For example, a packer assembly 320 may include one or more interior inserts 330 between inserts 324. FIG. 9 provides a front view of the arrangement of inserts 324 and interior inserts 330 of a packer assembly with the elastomeric body removed and FIG. 10 provides a bottom perspective transparent view of the arrangement of inserts 324 and interior inserts 330 of a packer assembly 320 including the elastomeric body 322.

The interior inserts 330 may be similar in shape and construction as that of the inserts 324, but the interior inserts 330 may be smaller than that of the inserts 324. For example, one or more dimensions of the interior inserts 330 is smaller than that of the inserts 324, in that the interior insert 330 may have a smaller width, height, length, and/or depth than that of the insert 324.

The interior inserts 330 are positioned between the inserts 324, such as by the having each of the inserts 330 positioned in between adjacent inserts 324 and in the gap formed between the inserts 324. In particular, the interior inserts 330 may be positioned within the elastomeric body 322 such that the interior insert 330 is positioned (e.g., axially) between the top support 340 and the bottom support 342 of the insert 324. For example, the axial position (with respect to an axis of the BOP housing) of the interior insert 330 may be at least partially between the top support 340 and the bottom support 342 of the insert 324. As with the inserts 324, the interior inserts 330 may be positioned in parallel alignment with each other and with the inserts 324. The interior inserts 330 are also movable in parallel with respect to each other and with respect to the inserts 324 within the elastomeric body 322. The interior inserts 330 may be used to facilitate the engagement and sealing ability of a packer assembly in accordance with one or more embodiments. For example, in an embodiment in which the inserts 324 may not be able to completely engage and seal about an object present within a blowout preventer, the interior inserts 330 may be able to move with respect to the inserts 324 to close upon and seal smaller gaps that the inserts 324 may not otherwise. The interior inserts 330 thus may be able to increase the operational pressures and temperatures for a BOP.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A packer assembly to form a seal within a blowout preventer ("BOP"), the packer assembly comprising:

an elastomeric body comprising an elastomeric material; and inserts positioned within the elastomeric body and in parallel alignment with respect to each other, wherein at least one of the inserts extends from an upper surface of the elastomeric body to a lower surface of the elastomeric body;

wherein the inserts are configured to move parallel with respect to each other to enable the packer assembly to form the seal about an object when the object is positioned within a vertical bore of the BOP and to enable the packer assembly to engage an opposed packer assembly to form the seal across the vertical bore when no object is positioned within the vertical bore of the BOP; and wherein the packer assembly further comprises additional inserts positioned within the elastomeric body and in between the inserts, wherein a respective height of the inserts is greater than a respective height of the additional inserts.

2. The packer assembly of claim 1, wherein at least one of the inserts comprises a top support, a bottom support, and a central support extending between the top support and the bottom support.

3. The packer assembly of claim 2, wherein the central support comprises a tapered front edge.

4. The packer assembly of claim 1, wherein the packer assembly is configured to:

form the seal about the object positioned off-center from a central axis of the vertical bore of the BOP; and form the seal about multiple objects positioned within the vertical bore of the BOP.

5. The packer assembly of claim 1, wherein the elastomeric body comprises a front surface that is configured to face the vertical bore of the BOP, and the inserts are arranged within the elastomeric body such that a respective front edge of each of the inserts is spaced apart from the front surface by a uniform distance.

6. A blowout preventer ("BOP"), comprising:

a housing comprising a vertical bore extending through the housing; and a packer assembly movably positioned within the housing and configured to form a seal within the housing, the packer assembly comprising:

an elastomeric body comprising an elastomeric material; and inserts positioned within the elastomeric body and in parallel alignment with respect to each other, wherein at least one of the inserts comprises a top support, a bottom support, and a central support extending between the top support and the bottom support;

wherein the inserts are configured to move parallel with respect to each other to enable the packer assembly to form the seal about an object when the object is positioned within the vertical bore of the housing and to enable the packer assembly to engage an opposed packer assembly to form the seal across the vertical bore when no object is positioned within the vertical bore of the housing; and wherein the packer assembly further comprises additional inserts positioned in between the inserts, and a respective height of the inserts is greater than a respective height of the additional inserts.

7. The BOP of claim 6, further comprising a ram assembly at least partially movable into the vertical bore of the housing, wherein the packer assembly is positioned upon the ram assembly.

8. The BOP of claim 7, wherein the inserts are configured to move only in parallel with the ram assembly.

9. The BOP of claim 6, wherein the packer assembly is configured to form the seal about the object positioned off-center from a central axis of the vertical bore of the housing.

10. The BOP of claim 6, wherein the packer assembly is configured to form the seal about multiple objects positioned within the vertical bore of the housing.

11. The BOP of claim 6, wherein the top support is positioned at an upper surface of the elastomeric body and the bottom support is positioned at a lower surface of the elastomeric body at least while the packer assembly is in an open position.

12. The BOP of claim 6, wherein each of the inserts and the additional inserts are positioned in parallel alignment with respect to each other.

13. The BOP of claim 6, wherein:

the inserts each comprise a top support, a bottom support, and a central support extending between the top support and the bottom support; and each additional insert is positioned axially between the top support and the bottom support of adjacent inserts.

14. The BOP of claim 6, wherein at least one of the inserts and at least one of the additional inserts are configured to move parallel with respect to each other.

15. The BOP of claim 6, wherein at least one of the inserts extends vertically across a midpoint of the elastomeric body along a vertical axis that is parallel to a central axis of the vertical bore.

* * * * *